United States Patent [19]

Reilly et al.

[11] Patent Number: 4,752,271

[45] Date of Patent: Jun. 21, 1988

[54] RUBBER BAND POWERED TOY BALLOON

[75] Inventors: Robin Reilly, Los Angeles; Robert Shepherd, North Hollywood; John Dykstra, Sherman Oaks; Grant McCune, Van Nuys; Thomas Valentine, Sherman Oaks, all of Calif.

[73] Assignee: Apogee, Inc., Van Nuys, Calif.

[21] Appl. No.: 40,843

[22] Filed: Apr. 21, 1987

[51] Int. Cl.[4] ..... A63H 27/10

[52] U.S. Cl. ..... 446/225; 446/35; 74/48

[58] Field of Search ..... 446/225, 220, 158, 59, 446/35; 244/33, 31, 29; 74/48

[56] References Cited

U.S. PATENT DOCUMENTS

| | | | |
|---|---|---|---|
| 787,515 | 4/1905 | Hunter | 446/225 |
| 1,765,435 | 6/1930 | McBride | 446/225 |
| 2,200,686 | 5/1940 | Beckman | 446/59 X |
| 3,656,586 | 4/1972 | Robson | 446/158 X |
| 4,547,167 | 10/1985 | Bergmann | 446/220 |

*Primary Examiner*—Mickey Yu

*Attorney, Agent, or Firm*—Blakely Sokoloff Taylor & Zafman

[57] ABSTRACT

A novel rubber band powered balloon is presented. No spine, frame, or other support member is used to resist the tension of the rubber band. Instead, the balloon, formed from a substantially non-elastomeric material, is sufficiently rigid when inflated such that supports for the rubber band can be directly connected to the balloon's outer skin. In addition, one embodiment of the present invention includes a novel flapping-vane propulsion system in which the rotational motion of the rubber band is converted into reciprocating motion of the vane.

3 Claims, 4 Drawing Sheets

FIN TRAVEL FOR 180° CRANK TURN

RUBBER BAND POWERED TOY BALLOON

BACKGROUND

1. Field of the Invention

The present invention relates to toy balloons and, more specifically, to a lighter-than-air, non-rigid, rubber band powered toy balloon using a propeller or a flapping vane for propulsion.

2. Art Background

Toy balloons have entertained youngsters and adults alike for many years. They have come in various shapes and sizes and have been filled with air, helium or even water.

Air filled toy balloons are often used for decorative purposes, or are repeatedly bounced or hit into the air for play. Because air filled balloons are heavier than air, however, they do not remain aloft very long.

Helium-filled balloons, on the other hand, are lighter than air and therefore tend to rise aloft. Hand held tethers are usually required to prevent helium-filled balloons to rising too far. If a helium-filled balloon is released indoors, it will rise up to the ceiling. If released outdoors, it will rise up to its buoyant height, which is the height at which the weight of the air displaced by the balloon (which decreases with increasing altitude) exactly equals the balloon weight. Conventional helium-filled toy balloons usually have buoyant heights of several hundred feet.

The buoyant height of a helium-filled balloon can be changed by altering the weight of the balloon, its helium content or both. At least one prior art design uses removable weights that can be affixed to the outside surface of the balloon to change the balloon's weight, while another adds weights to a container suspended below the balloon. By adjusting the weight of the balloon in sufficiently small increments, it is possible to adjust the buoyant height within a range of about 5 to 10 feet.

To add horizontal movement to a balloon's behavior, several prior art designs have outfitted balloons with rubber band powered propeller mechanisms. In the prior art, such mechanisms have included a rubber band, a propeller, and a support frame or spine for resisting the tension of a fully wound rubber band. The support frame may be disposed within, attached to the outside, or suspended beneath the balloon. Single or double propellers have been used.

SUMMARY OF THE INVENTION

The present invention consists of a rubber band powered balloon in which no spine, frame or other support member is used to resist the tension built up in the rubber band. Instead, the balloon, formed from a substantially non-elastomeric material, is sufficiently rigid when inflated with air or helium such that the rubber band supports can be directly connected to the balloon's outer skin.

In addition, in one embodiment of the present invention a unique flapper vane, rather than a propeller, is used to power the balloon. A special slot-and-pin configuration is used to transform the rotary motion of the rubber band into the reciprocating flapping motion of the flapper. The balloon can be shaped like a fish and counterweighted such that its buoyant height is between 5 and 10 feet off the ground. When the rubber band is wound up and the balloon is released, the flapper will slowly propel the balloon along, the balloon giving the impression of a fish swimming in the air.

DETAILED DESCRIPTION OF THE INVENTION

An improved rubber band powered balloon is disclosed. In the following description, for purposes of explanation, numerous details are set forth, such as specific materials, arrangements and proportions in order to provide a thorough understanding of the present invention. However, it will be apparent to one skilled in the art that the invention may be practiced without these specific details. In other instances, well-known components, such as rubber bands, adhesive tapes, and propellers. have not been described in detail in order not to obscure the present invention unnecessarily.

Figure 1:
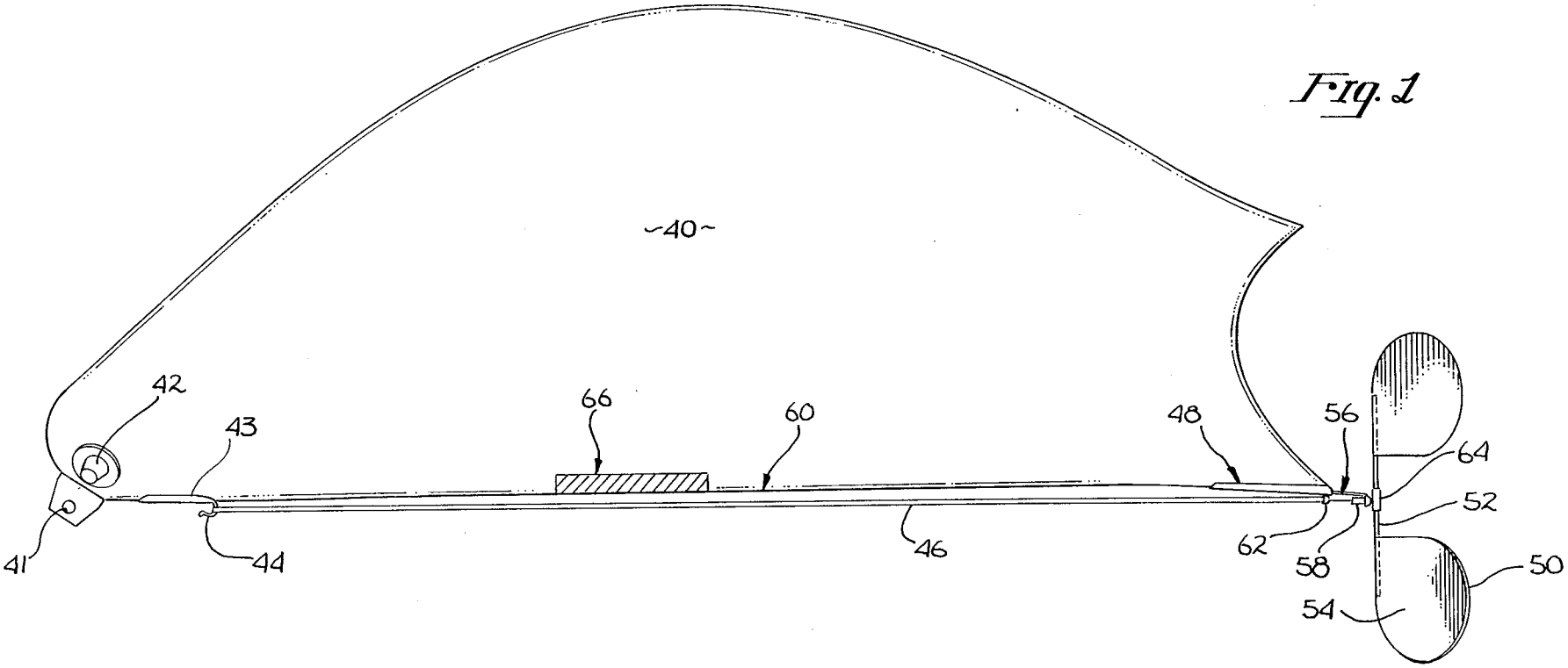
FIGS. 1 and 2 are side and bottom views, respectively, of one embodiment of the present invention.
Figure 2:
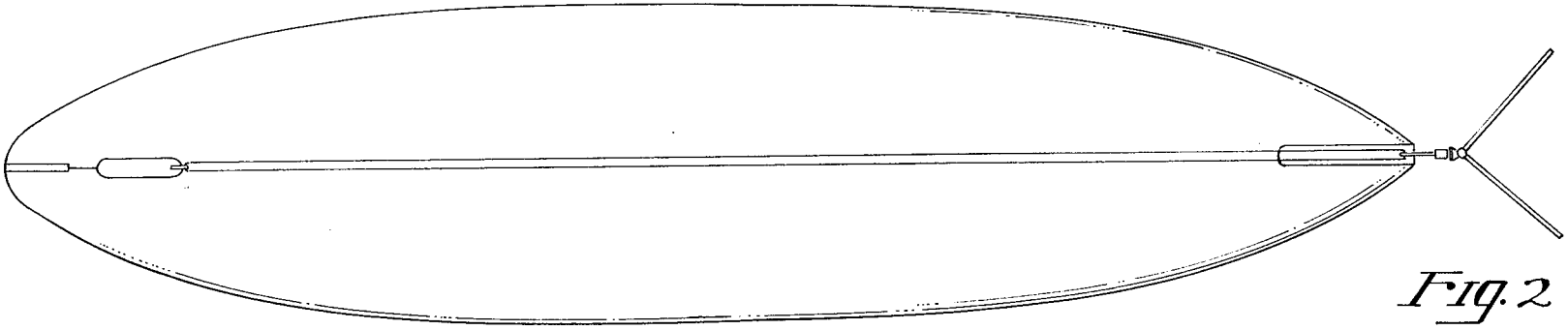

Referring first to FIGS. 1 and 2, these Figures show side and bottom views respectively of one embodiment of the present invention. This embodiment comprises an elongated balloon 40 having a straight bottom edge 60 and generally rounded front, top and rear edges. The balloon is made of two pieces of a thin, gas impermeable, substantially non-elastomeric plastic film. In the preferred embodiment the material is a metal coated polycarbonate, or metal coated nylon. These pieces are shaped as mirror images of each other in the general shape of the side profile of the finished balloon illustrated in FIG. 1, and are bonded together, preferably by heat sealing, along their edges. A valve 42 is installed to allow the filling of the balloon with a gas, preferably helium.

The shape of the balloon and the non-elastomeric nature of its skin gives the balloon a significant amount of structural rigidity, once the balloon has been inflated. The balloon can therefore be fitted with a rubber band powered propulsion system without the need of a rigid spine or other structural support member to resist tension that is built up in a fully wound rubber band. As a result, a very simple, lightweight and effective propulsion system and mounting means can be used.

Figures 3, 4, 5:
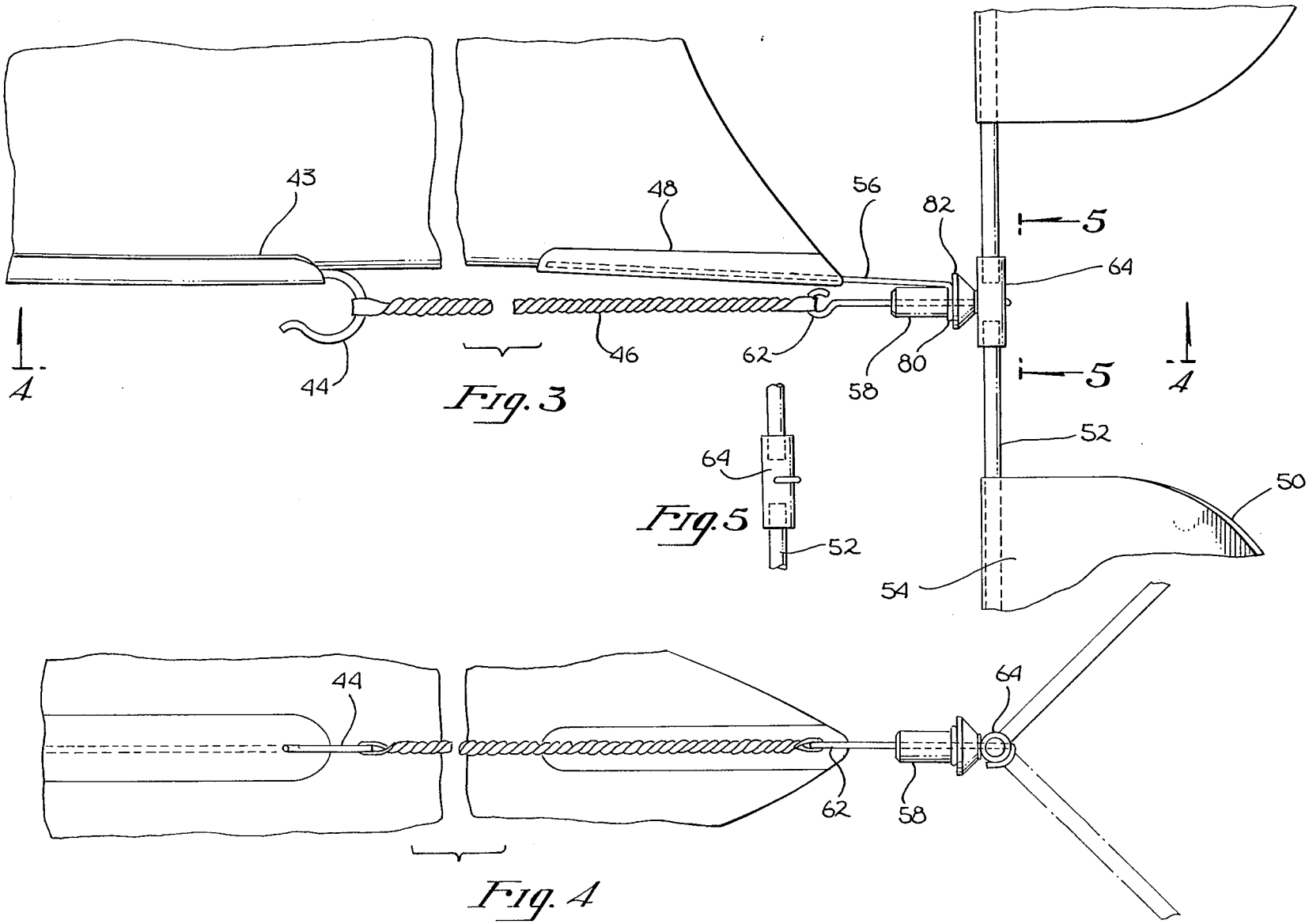
FIGS. 3 and 4 are detailed side and bottom views, respectively, of the propulsion means of the embodiment of FIGS. 1 and 2.
FIG. 5 is a detailed view of the hub of the propeller of the embodiment of FIGS. 3 and 4.

The propulsion system is shown in greater detail in FIGS. 3, 4 and 5. Referring to FIGS. 1 and 3, the propulsion system comprises front rubber band hook 44, rubber band 46, rear rubber band hook 62, rear wire loop 56, thrust bushing 58 and propeller 50.

Front hook 44 and rear wire loop 56 are attached to the outside skin of the balloon by means of tapes 43 and 48, respectively. The shank portions of front hook 44 and rear wire loop 56 may be straight, as shown in FIGS. 1 and 3 or they may have bent or looped shanks to improve their adhesion to tapes 43 and 48. Tapes 43 and 48 may be of plastic, cloth, paper or other materials and are coated on one side with an appropriate pressure adhesive, for instance an acrylic pressure adhesive. Front hook 44 and rear wire loop 56 are placed into position along the bottom seam 60 of the balloon 40 and tapes 43 and 48 are applied.

Propeller 50 may be of an appropriate design and in the present embodiment consists of a plastic hub 64, a wooden shaft 52 and two paper blades 54. The paper blades 52 are angled such that spinning of the propeller creates forward thrust, as illustrated in FIGS. 2 and 4. Propeller 50 is attached to the balloon by means of thrust bearing 58, rear wire loop 56 and rear rubber band hook 62.

Referring now to FIGS. 3 and 4, thrust bearing 58 fits through loop 80 of wire loop 56 such that its flange 82 rests against loop 80. The shank of rear rubber band hook 62 passes through holes in the center of thrust bearing 82 and propeller hub 64 and is bent around hub 64 as shown in FIG. 4. Rubber band 46 is then hooked between front hook 44 and rear hook 62. The tension in rubber band 46 prevents the propeller assembly from disengaging from rear wire loop 56.

Referring once again to FIG. 1, a mooring tab 41 may be fitted to the front portion of the balloon, preferably by means of an adhesive tape.

After the balloon has been fully assembled and inflated, ballast weights are attached in ballast zone 66 to give the balloon a neutral buoyancy such that it hovers at an altitude of about 4 to 10 feet. The ballast weights are removable and may consist of pieces of metal or fabric tape, which are trimmed to adjust the ballast.

After the initial ballast has been added, the weight of the balloon can be fine tuned by the addition or removal of small amounts of ballast to compensate for changes in such factors as temperature, humidity and altitude of the location where the balloon is to be used.

To operate the balloon, after it has been ballasted, the rubber band is wound, for instance by spinning the propeller in a backwards direction (backwards meaning in the direction opposite which it is desired for the propeller to spin in its operative mode) until the twisting builds up tension in the rubber band. The rubber band in its fully wound state is illustrated in FIGS. 3 and 4. It should be noted that the propeller may be used in either a pulling or a pushing mode. The balloon is then held aloft, and released. The neutral buoyancy of the balloon causes it to hover in mid-air. As the propeller starts to spin and produce thrust, the balloon begins to move through the air in a free floating, entertaining fashion. The balloon will continue to move about until the potential energy stored in the rubber band has been expended, after which the balloon will slowly glide to rest.

Figure 6:
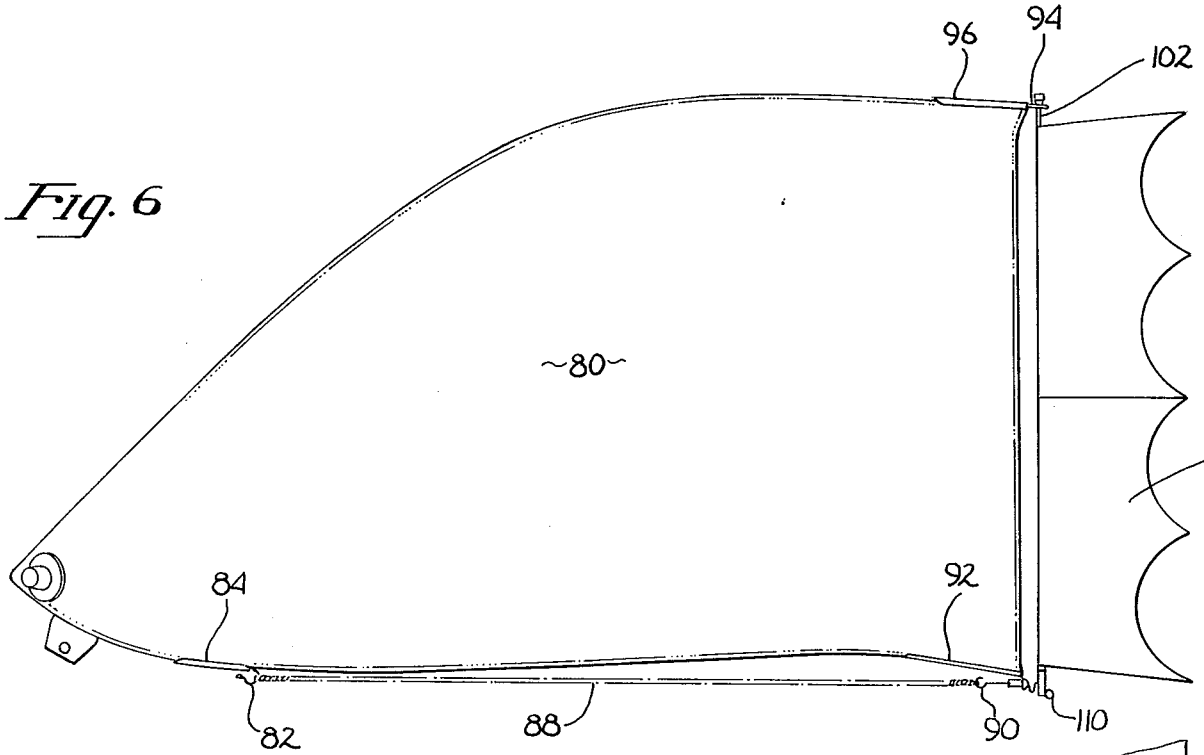
FIGS. 6 and 7 are side views of a second embodiment of the present invention.
Figure 7:
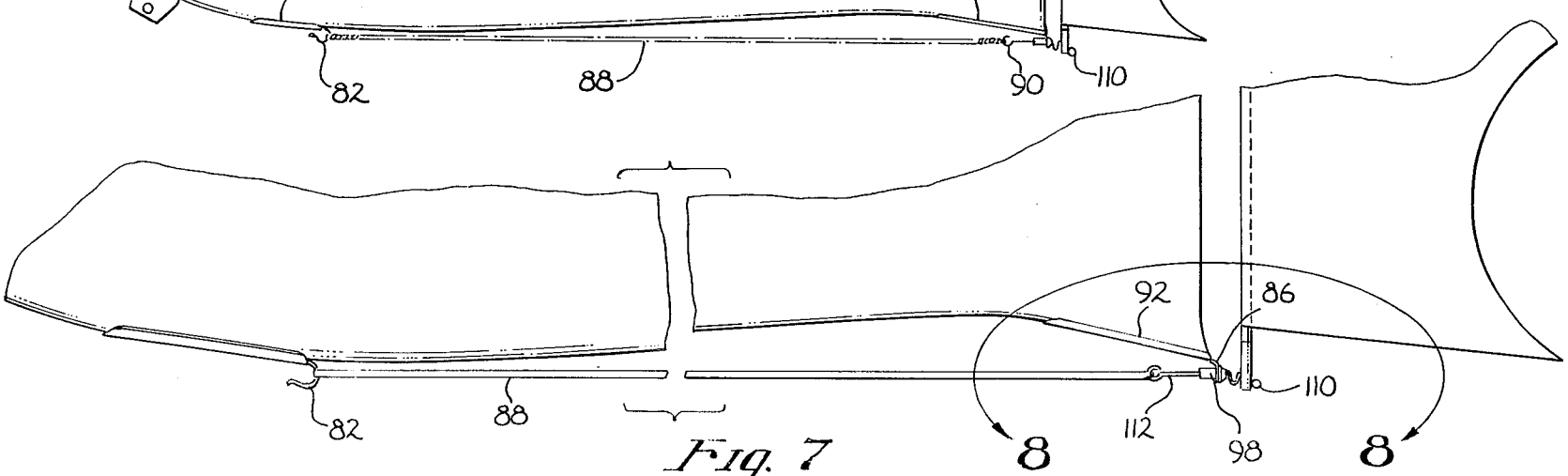

A second embodiment of the present invention is shown in FIGS. 6 and 7. In this embodiment, a novel reciprocating flapper vane mechanism is used to propel the balloon. The flapper vane propulsion mechanism is shown in greater detail in FIGS. 8, 9, 10 and 11.

Like in the previous embodiment, the propulsion system of the present embodiment includes in front hook 82 attached to the balloon by adhesive tape 84, a rubber band 88, a rear hook 90, a thrust bearing 98 and a rear wire loop 86 secured to the balloon by adhesive tape 92. The present invention does not include a propeller, however, but uses a reciprocating flapper vane.

Figure 8:
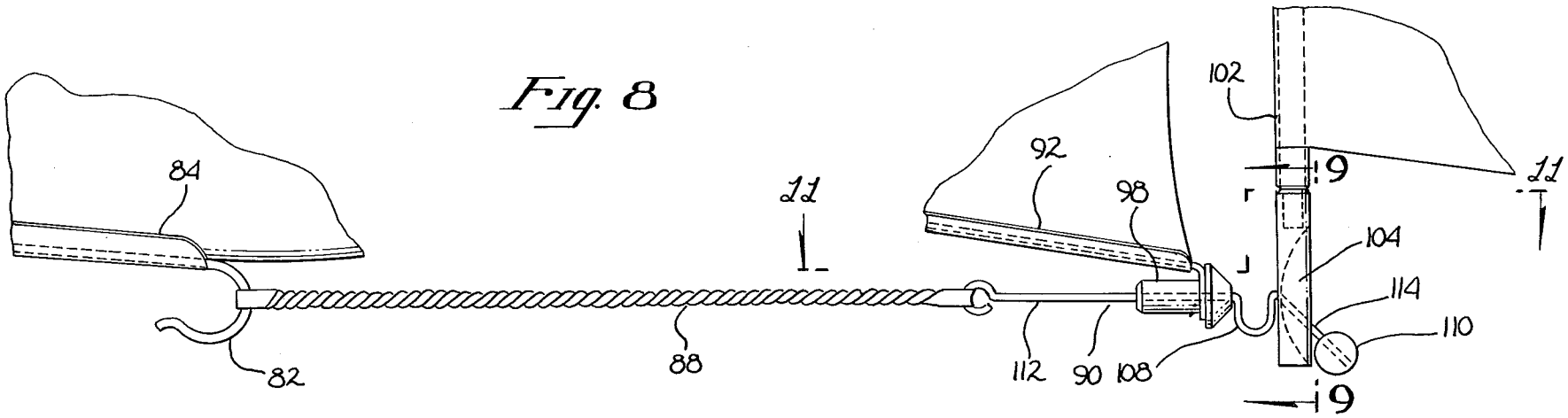
FIGS. 8, 9, 10 and 11 are detailed views of the flapper propulsion mechanism of the embodiment of FIGS. 6 and 7.
Figure 9:
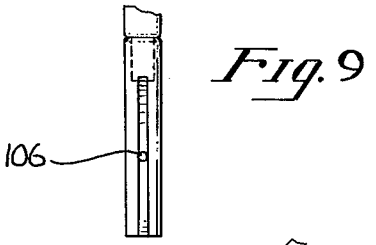

The flapper vane consists basically of a vane 100 of relatively stiff material, such as paper, attached to a shaft 102, preferably made of wood. The top of the shaft is fitted into an upper rear wire loop 94 attached to the upper back portion of the balloon 80 by means of adhesive tape 96. Turning to FIGS. 8, 9, 10 and 11, the lower end of the shaft 102 is fitted with a thin semi-circular slot 104 and a pin hole 106. The shank of rear hook 90 is formed into a u-shaped portion 108 after it emerges from thrust bearing 98 and the remaining end 114 is bent such that it makes an angle of approximately 45° with its major shank portion 112, all as illustrated in FIG. 8. The slotted end 104 of flapper shaft 102 is fitted over the end of rear hook 90 such that pin hole 106 engages the angled shank portion 114, and locking bead 110 is attached to the end of shank portion 114.

Figure 11:
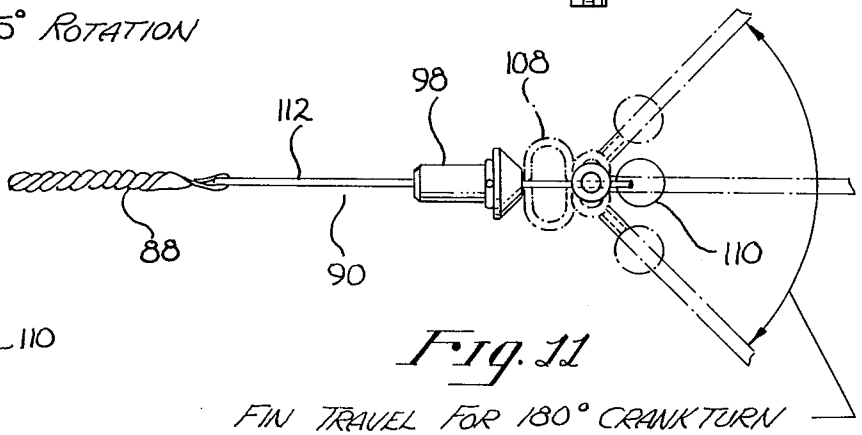

The slot 104 and angled portion 114 of rear hook 90 transform the rotational motion of the unwinding rubber band into reciprocating motion of the tail as follows. As the rubber band unwinds, it rotates rear hook 90 in thrust bearing 98. As rear hook 90 rotates, its angled rear portion 114 describes a horizontal cone. When viewed from below, the rotation of the angled end 114 gives the appearance of swinging from side to side as shown in FIG. 11. Viewed from the side, the movement of the angled end 114 would similarily appear to swing up and down in the plane perpendicular to the direction of view. The movement of the angled end 114 can therefore be considered to be a combination of the horizontal swinging component illustrated in FIG. 11 and a vertical swinging component described above.

Figure 10:
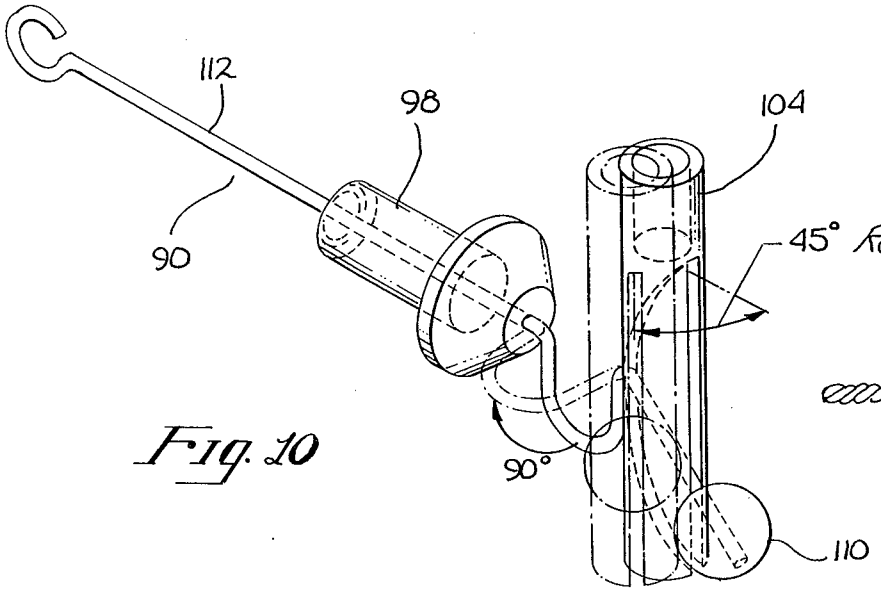

The semi-circular slot 104 in tail shaft 102 allows free movement of the angled end 114 in the vertical direction while transferring the horizontal swinging component directly to flapper shaft 102. The result is that, as the rear hook 112 spins, flapper shaft 102 is swung side to side, as shown in FIGS. 10 and 11. The resulting flapping motion of the vane 100 gently propels the balloon along.

The flapper vane propulsion mechanism of the present invention allows stunning visual effects to be created by the motion of a balloon. For example, if the balloon is shaped to have a fish-like profile as in the present embodiment, and the flapper vane is shaped like a fish tail the balloon will resemble a fish swimming through the air. Such a resemblance can be emphasized by printing colorful graphics, such as fish scales, eyes and gills, on the balloon. A particularily entertaining effect can be created by releasing several balloons of varying fish designs in the air simultaneously, creating the impression of being immersed in an aquarium.

Accordingly, a novel rubber band powered toy balloon has been presented. The toy balloon of the present invention allows the rubber band to be directly attached to the skin of the balloon without requiring any additional structural supports, something that was not possible in the prior art. In addition, a novel flapping vane propulsion system, not known in the prior art, is used. Although specific details are described herein, it will be understood that various changes can be made in the materials, details, arrangements and proportions of the various elements of the present invention without departing from the scope of the invention. For example, although the specification refers primarily to the use of rubber bands for propulsion, other elastic bands may be used. More than one rubber band propulsion system may be mounted on the balloon, and a single balloon may incorporate a propeller as well as a flapper. The flapper need not be mounted vertically but may be mounted horizontally or in any other desired orientation. The balloon may be made of a variety of substantially non-elastomeric materials and may have any desired shape. The balloon may be used for advertising purposes as well as for entertainment. The flapper may be used to propel other toys and models in addition to toy balloons. Other variations will be apparent to those skilled in the art.

We claim:

1. An elastic band powered ballon assembly, said assembly comprising:

a ballon capable of being filled with a buoyant gas and having an outer surface;

an elastic band having a first and a second end, said elastic band capable of being rotatably placed under tension;

first fixed attachment means for non-rotatably attaching a first end of said elastic band to the outer surface of said balloon at a first location comprising a hook fastened to said outer surface of said balloon engageable with said first end of said elastic band;

second rotating attachment means for rotatably attaching a second end of said elastic band to the outer surface of said balloon at a second location, said second location being located at a distance from said first location approximately equal to the unstretched length of said elastic band, said second attachment means including:

hook means for retaining and engaging said second end of said elastic band; and bearing means fastened to said outer surface of said balloon, said hook means rotatably interconnected with said bearing means;

said balloon being sufficiently rigid when filled with said buoyant gas to resist said tension in said elastic band;

thrust producing means mechanically interconnected with said rotating attachment means, such that rotation of said rotating attachment means causes said thrust producing means to produce thrust for propelling said balloon assembly;

whereby when said elastic band is rotatably placed under tension, said tension in said elastic band causes said rotating attachment means to rotate, thereby producing thrust to propel said balloon assembly.

2. A reciprocating vane mechanism for propelling an elastic band powered toy, said toy comprising an elastic band attached to said toy such that said elastic band may be rotatably placed under tension and such that said tension of said elastic band can be made to cause the rotation of a first shaft means, said reciprocating vane mechanism comprising:

a vane, said vane comprising a membrane attached to a second shaft means, said second shaft means having a first longitudinal axis;

hinge means for pivotably attaching said vane to said toy such that said vane pivots about said first axis; and coupling means for transforming rotation of said first shaft means into a reciprocating motion of said vane about said first axis comprising:

a vertical slot formed in said second shaft means, said vertical slot formed along a radius of said second shaft means, said slot extending only partially through said second shaft means in a radial direction;

a pin hole extending from said slot in said radial direction through said shaft;

said first shaft means including a straight shank portion disposed along a second axis of rotation of said first shaft means and an angled dog leg portion, such that rotation of said first shaft means causes said angled dog leg portion to trace out a conical surface of revolution; and said angled dog leg portion being disposed in said slot in said second shaft means such that rotation of said angled dog leg causes said second shaft to reciprocatingly pivot about said first longitudinal axis, causing said vane to reciprocatingly pivot about said first longitudinal axis;

whereby said tension in said elastic band produces a thrust generating reciprocating flapping motion of said vane.

3. An elastic band powered balloon assembly, said assembly comprising:

a balloon capable of being filled with a buoyant gas and having an outer surface;

an elastic band having a first and a second end, said elastic band capable of being rotatably placed under tension;

first fixed attachment means for non-rotatably attaching a first end of said elastic band to the outer surface of said balloon at a first location;

second rotating attachment means for rotatably attaching a second end of said elastic band to the outer surface of said balloon at a second location, said second location being located at a distance from said first location approximately equal to the unstretched length of said elastic band; and thrust producing means mechanically interconnected with said rotating attachment means, such that rotation of said rotating attachment means causes said thrust producing means to produce thrust for propelling said balloon assembly, said thrust producing means comprising a reciprocating vane mechanism, including:

a vane, said vane comprising a membrane attached to a shaft, said shaft having a first longitudinal axis;

hinge means for pivotably attaching said vane to said balloon such that said vane pivots about said first axis; and coupling means for transforming the rotational motion of said second attachment means into a reciprocating motion of said vane about said first axis, said coupling means comprising:

a vertical slot formed in said shaft, said vertical slot formed along a radius of said shaft, said slot extending only partially through said shaft in a radial direction;

a pin hole extending from said slot in said radial direction through said shaft;

said second rotating attachment means including a straight shank portion disposed along a second axis of rotation of said rotating attachment means and an angled dog leg portion, such that rotation of said rotating attachment means causes said angled dog leg portion to trace out a conical surface of revolution; and said angled dog leg portion being disposed in said slot in said shaft such that rotation of said angled dog leg causes said shaft to reciprocatingly pivot about said first axis, causing said vane to reciprocatingly pivot about said first axis;

whereby when said elastic band is rotatably placed under tension, said balloon is sufficiently rigid when filled with said buoyant gas to resist said tension in said elastic band, and whereby said tension in said elastic band causes said rotating attachment means to rotate, thereby producing thrust to propel said balloon assembly.

* * * * *